United States Patent [19]

Yamasaki

[11] 4,071,802

[45] Jan. 31, 1978

[54] HOLLOW-CATHODE SPECTRAL LIGHT SOURCE WITH MEANS TO PREVENT HIGH VOLTAGE ARCING

[75] Inventor: George K. Yamasaki, Horseheads, N.Y.

[73] Assignee: Westinghouse Electric Corporation, Pittsburgh, Pa.

[21] Appl. No.: 687,839

[22] Filed: May 19, 1976

[51] Int. Cl.[2] ..... H01J 61/04

[52] U.S. Cl. ..... 313/209; 313/207; 313/239

[58] Field of Search ..... 313/209, 207, 239, 313

[56] References Cited

U.S. PATENT DOCUMENTS 3,264,511 8/1966 Yamasaki ..... 313/209

*Primary Examiner*—Rudolph V. Rolinec
*Assistant Examiner*—Darwin R. Hostetter
*Attorney, Agent, or Firm*—W. G. Sutcliff

[57] ABSTRACT

A hollow-cathode type spectral light source is provided with additional means to prevent high voltage breakdown between the anode and the outside of the cathode. The means is a resilient annular high-voltage shield member which is disposed between the conventional insulating disc and the envelope.

5 Claims, 1 Drawing Figure

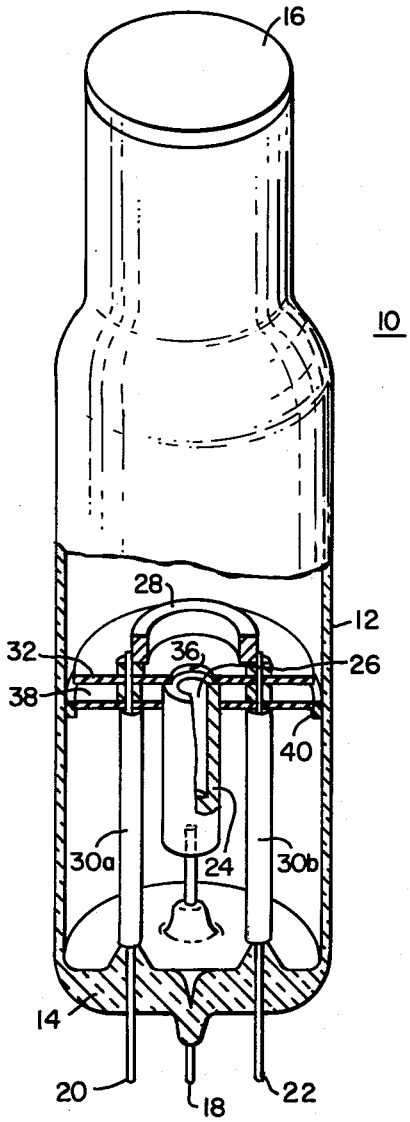
16
10
28
12
32
36
26
38
40
30a
24
30b
14
20
18
22

HOLLOW-CATHODE SPECTRAL LIGHT SOURCE WITH MEANS TO PREVENT HIGH VOLTAGE ARCING

BACKGROUND OF THE INVENTION

The present invention relates to spectral light sources, and more particularly to hollow-cathode type light sources.

Hollow-cathode spectral light sources are used in atomic absorption spectroscopy. Such light sources provide high intensity, sharply defined spectral lines for many analytical applications. A conventional hollow-cathode type light source design is seen in U.S. Pat. No. 3,264,511. The spectral light is produced as a result of a concentrated discharge which takes place between an anode and the hollowed portion of the cathode. The hollowed portion of the cathode contains the atomic species which generate the desired spectral light output. The discharge must be confined to the hollow portion of the cathode in order to achieve efficient operation. The teaching of U.S. Pat. No. 3,264,511 was that an insulating disc should be positioned between the anode and cathode, with the disc having a central aperture aligned with the hollow portion of the cathode. An insulating means is also taught as being disposed between the anode lead-in and the exterior of the cathode.

The insulating disc serves as the primary insulating means between the anode and the exterior of the cathode to insure that the discharge is confined to the cathode hollow. In order to facilitate assembly of the device, the insulating disc has a diameter which is less than the inside diameter of the glass envelope. There is thus some spacing between the outer edge of the disc and the glass envelope. This spacing is advantageous during evacuation of the envelope, since this is carried out through the base of the envelope.

For selected hollow-cathode devices, particularly for those where it is difficult to initiate the discharge, a relatively high starting voltage pulse, of for example 500–600 volts, is placed across the anode and cathode. The normal gas fill for such devices is several torr of inert gas such as argon. It has been found that with such high voltages some arcing takes place around the edges of the mica insulating disc between the anode and the exterior surface of the cathode, and this complicates starting the main discharge.

SUMMARY OF THE INVENTION

A hollow-cathode type spectral light source is provided with means to prevent high voltage breakdown between the anode and the exterior surface of the cathode. The device comprises a hermetically sealed, generally cylindrical envelope at least a portion of which is transmissive of the spectral light generated. A selected fill gas is provided within the space defined by the envelope. A hollow cathode is disposed within the space defined by the envelope, with the cathode aligned with the envelope longitudinal axis. An anode is spaced from the hollowed end of the cathode. At least one thin insulating disc is disposed between the anode and the exterior portion of the cathode in a plane transverse to the longitudinal axis. A central aperture is provided through the insulating disc aligned with the hollow of the cathode. The insulating disc has a diameter slightly less than the cylindrical envelope inside diameter. The improvement in the device is a resilient annular high-voltage shield member. This member is disposed about the insulating disc between the disc and the envelope, to prevent high-voltage breakdown between the anode and the cathode exterior.

BRIEF DESCRIPTION OF THE DRAWINGS

The sole FIGURE is an enlarged perspective view partly in section of the hollow-cathode spectral light source of the present invention.

DESCRIPTION OF THE PREFERRED EMBODIMENT

The present invention can be best understood by reference to the embodiment seen in the drawings. In the sole FIGURE the hollow-cathode spectral light source 10 has a generally cylindrical, hermetically sealed light transmissive envelope 12. A selected fill gas, such as neon or argon, is provided within the space defined by the envelope at a pressure of several torr. The envelope 12 is a vitreous material such as glass, and has a base 14 at one end, and a highly transmissive window 16 at the other end which is typically formed of quartz.

A plurality of electrical lead-ins 18, 20, 22 are sealed through the base 14. One lead-in 18 is electrically connected to and supports a hollow-cathode 24. The hollowed portion 26 of the hollow-cathode 24 is at the end facing the window 16. The hollow-cathode is aligned along the longitudinal axis of the envelope. The lead-ins 20 and 22 support and are electrically connected to a ring anode 28 which is spaced from the hollowed portion 26 of the cathode 24. Ceramic insulating sleeves **30*a*, 30*b* are provided over the lead-ins 20 and 22 to insulate these lead-ins from the cathode. In the embodiment shown a first insulating disc 32 is provided between the anode and cathode. The insulating disc 32 is preferably a thin mica disc. The disc 32 is supported by ceramic sleeve portions 34 provided over the lead-ins 20 and 22. The disc 32 has a central aperture 36 aligned with the hollow portion of the cathode. The disc 32 is disposed transverse to the envelope longitudinal axis. A second insulating disc 38 may be provided about the hollow cathode 24, parallel to and closely spaced from the first disc 32**.

The discs 32 and 38 have diameters which are just less than inside diameter of the cylindrical glass envelope.

A resilient, annular high-voltage shield member 40 is disposed about at least one of the insulating discs, between the discs and the envelope. The shield member 40 serves to prevent high-voltage breakdown occurring around the edge of the disc between the anode and the exterior of the cathode.

The shield member 40 is preferably formed of an insulating material such as ceramic fiber material, "Fiberfrax" Type 970-JH, a trademarked material available from the Carborundum Company of Niagara Falls, New York. This ceramic fibrous material is basically fibers of alumina and silica. The material has a dielectric strength of 100 volts per mil and is a high-temperature material which is usable continuously at 2300° F. The material has an uncompressed density of about 10 pounds per cubic foot and is highly resiliently compressible. The annular member 40 has by way of example a thickness of about 80 mils and a width of about 80 mils. The width should be sufficient to completely fill the space between the outer edge of the disc and the glass. Since the material is resilient it can be easily forced between the disc edge and the glass and supported between them. This ceramic fiber material also has the advantage that it is porous, and even when compressed in place between the mica disc and the envelope this porous material facilitates evacuation of the envelope during fabrication.

A plurality of mica discs may be utilized, and while a single resilient annular shield member about any of the mica discs will prevent the high-voltage breakdown, if desired such a shield member may be provided with each mica disc.

Other resilient materials can be substituted for the ceramic fiber material high-voltage shield material. The material used must be able to withstand the operating temperature without outgassing. The material must have the desired resiliency to be force-fitted between the mica disc and the tube envelope. The material can be felt, glass wool, or even metal wool so long as the metal has a large enough potential drop associated therewith to prevent any discharge from forming.

What is claimed is:

1. A hollow-cathode type spectral light source comprising a hermetically sealed generally cylindrical envelope at least a portion of which is transmissive of the spectral light generated, a selected fill gas within the envelope defined space, a hollow cathode disposed within the space aligned with longitudinal axis of the envelope, an anode spaced from the hollowed end of the hollow cathode, at least one insulating disc disposed between the anode and the exterior portion of the hollow cathode with a central aperture provided through the disc aligned with the hollow in the hollow cathode, which insulating disc has a diameter which is slightly less than the cylindrical envelope diameter, the improvement wherein a resilient, annular, highvoltage shield member is disposed about the insulating disc between the disc and the envelope to prevent high-voltage breakdown between the anode and the cathode exterior.

2. The device specified in claim 1, wherein the resilient annular shield member is an electrical insulator.

3. The device specified in claim 1, wherein the resilient annular shield member is porous.

4. The device specified in claim 1, wherein the resilient annular shield member is fibrous ceramic material.

5. The device specified in claim 1, wherein at least one other insulating disc is disposed parallel to and spaced from the insulating disc which is disposed between the anode and cathode, which other insulating disc is disposed about the cathode, and the resilient annular high-voltage shield member is disposed about the other disc between the other disc and the envelope.

* * * * *